United States Patent [19]

Hanna et al.

[11] Patent Number: 4,773,772

[45] Date of Patent: Sep. 27, 1988

[54] PRINTING APPARATUS

[75] Inventors: Kenneth W. Hanna; Robert L. Wirth; Richard S. Beardsley, II, all of Ithaca, N.Y.

[73] Assignee: NCR Corporation, Dayton, Ohio

[21] Appl. No.: 874,317

[22] Filed: Jun. 13, 1986

[51] Int. Cl.[4] ..... B41J 11/08; B41J 11/20

[52] U.S. Cl. ..... 400/58; 400/649; 292/201

[58] Field of Search ..... 292/201, 230; 400/58, 400/212, 649, 656

[56] References Cited

U.S. PATENT DOCUMENTS

| | | | |
|---|---|---|---|
| 766,117 | 7/1904 | Rundle | 188/171 |
| 984,748 | 2/1911 | Coleman | 335/236 |
| 1,005,855 | 10/1911 | Lindquist | 335/244 |
| 1,134,779 | 4/1915 | Trezise, Sr. | 335/262 |
| 1,227,568 | 5/1917 | Barber | 335/155 |
| 2,462,482 | 4/1946 | Evans | 175/341 |
| 2,656,491 | 10/1953 | Wallace et al. | 317/178 |
| 2,946,875 | 11/1958 | Waldhauer, Jr. | 200/103 |
| 3,109,516 | 11/1963 | Leo et al. | 292/230 |
| 3,236,964 | 3/1964 | Sommer | 200/87 |
| 3,344,377 | 9/1965 | Clements | 335/259 |
| 3,713,059 | 1/1973 | Tada | 335/259 |
| 3,776,341 | 12/1973 | Dobner et al. | 400/649 |
| 3,868,008 | 2/1975 | Brumbaugh | 400/56 |
| 3,955,663 | 5/1976 | Ecker | 400/656 |
| 3,995,730 | 12/1976 | Kwan et al. | 400/649 |
| 4,098,389 | 7/1978 | Kwan | 400/649 |
| 4,227,819 | 10/1980 | Manriquez | 400/56 |
| 4,256,408 | 3/1981 | Shelton | 400/352 |
| 4,428,607 | 1/1984 | Levine | 292/201 |
| 4,483,633 | 11/1984 | Kosner, Jr. et al. | 400/649 |
| 4,575,267 | 3/1986 | Brull | 400/56 |
| 4,667,990 | 5/1987 | Quantz | 292/201 |

FOREIGN PATENT DOCUMENTS

| | | | |
|---|---|---|---|
| 3021988 | 12/1981 | Fed. Rep. of Germany | 400/212 |
| 3510857 | 10/1986 | Fed. Rep. of Germany | 400/212 |
| 146670 | 9/1982 | Japan | 400/58 |
| 160173 | 9/1983 | Japan | 400/656 |
| 18367 | 1/1985 | Japan | 400/649 |

OTHER PUBLICATIONS

Anderson, "Automatic Adjusting . . . Station" IBM Technical Disclosure Bulletin, vol. 24, No. 11B, pp. 6158–6159, 4–81.

*Primary Examiner*—William Pieprz

*Attorney, Agent, or Firm*—Wilbert Hawk, Jr.; Albert L. Sessler, Jr.

[57] ABSTRACT

A printing apparatus is disclosed in which a platen is mounted on a forms compensation device which is pivotally mounted so as to enable record media of varying thicknesses to be placed between the platen and associated printing elements to enable printing thereon. The forms compensation device is held in printing position by latch elements thereon which cooperate with complementary elements on the printer frame. The latch elements are associated with oppositely acting axially positioned armatures of a single-coil solenoid mounted on the forms compensation device, so that the solenoid is energized only when it is desired to move the latch elements out of engagement with the complementary elements on the printer frame, to enable the forms compensation device to be moved to a remote non-printing position in which record media may readily be inserted between the platen and the associated printing elements. The forms compensation device is so configured that it moves to said remote position under the force of gravity when said latch elements are moved out of engagement with the complementary elements on the printer frame.

18 Claims, 5 Drawing Sheets

PRINTING APPARATUS

BACKGROUND OF THE INVENTION

Printers capable of printing on record media of various thicknesses, such as single sheets, multisheet forms, passbooks, etc., are widely used in various types of business machines, such as financial and retail terminals, for example. In such printers, it is advantageous to be able to increase the gap or throat between the platen and the printing elements in order to facilitate insertion of record media therebetween. This can be done, for example, by means of energization of a solenoid to separate the platen from the printing elements by moving one or the other. However, if the solenoid must be maintained in an energized condition during the time that the platen and the printing elements remain spaced apart, excessive power consumption and wear of the solenoid may result.

SUMMARY OF THE INVENTION

This invention relates to printing apparatus, and more particularly relates to printing apparatus having a forms compensation mechanism and means to control record media throat opening.

It is accordingly an object of the present invention to provide a printing apparatus having an automatic forms compensation mechanism with control of throat opening for record media insertion.

Another object is to provide a printing apparatus having an automatic forms compensation mechanism with solenoid control for enabling the opening of a throat for record media insertion.

Another object is to provide a printing apparatus having an automatic forms compensation device which can be released for opening of a throat for record media insertion by momentary energization of an operating solenoid and which forms compensation device will move to open position by the force of gravity after having been released by said momentary energization of said solenoid.

Another object is to provide printing apparatus having record media throat opening capability of novel and efficient design.

Another object is to provide printing apparatus having a throat opening mechanism for record media insertion in which no force is required to maintain the throat in open position.

Another object is to provide a printing apparatus having an automatic forms compensation device which can be released for movement to a remote position by operation of a single coil solenoid having axially aligned armatures operable in opposite directions upon energization of said solenoid, said armatures having latch elements associated therewith and adapted to cooperate with complementary elements on the frame of said printing apparatus.

With these and other objects, which will become apparent from the following description, in view, the invention includes certain novel features of construction and combinations of parts, preferred forms or embodiments of which are hereinafter described with reference to the drawings which accompany and form a part of this specification.

BRIEF DESCRIPTION OF THE DRAWINGS

FIGS. 6, 7 and 8 show three alternative housing structures for the solenoid of FIG. 5

DESCRIPTION OF THE PREFERRED EMBODIMENTS

Figure 1:
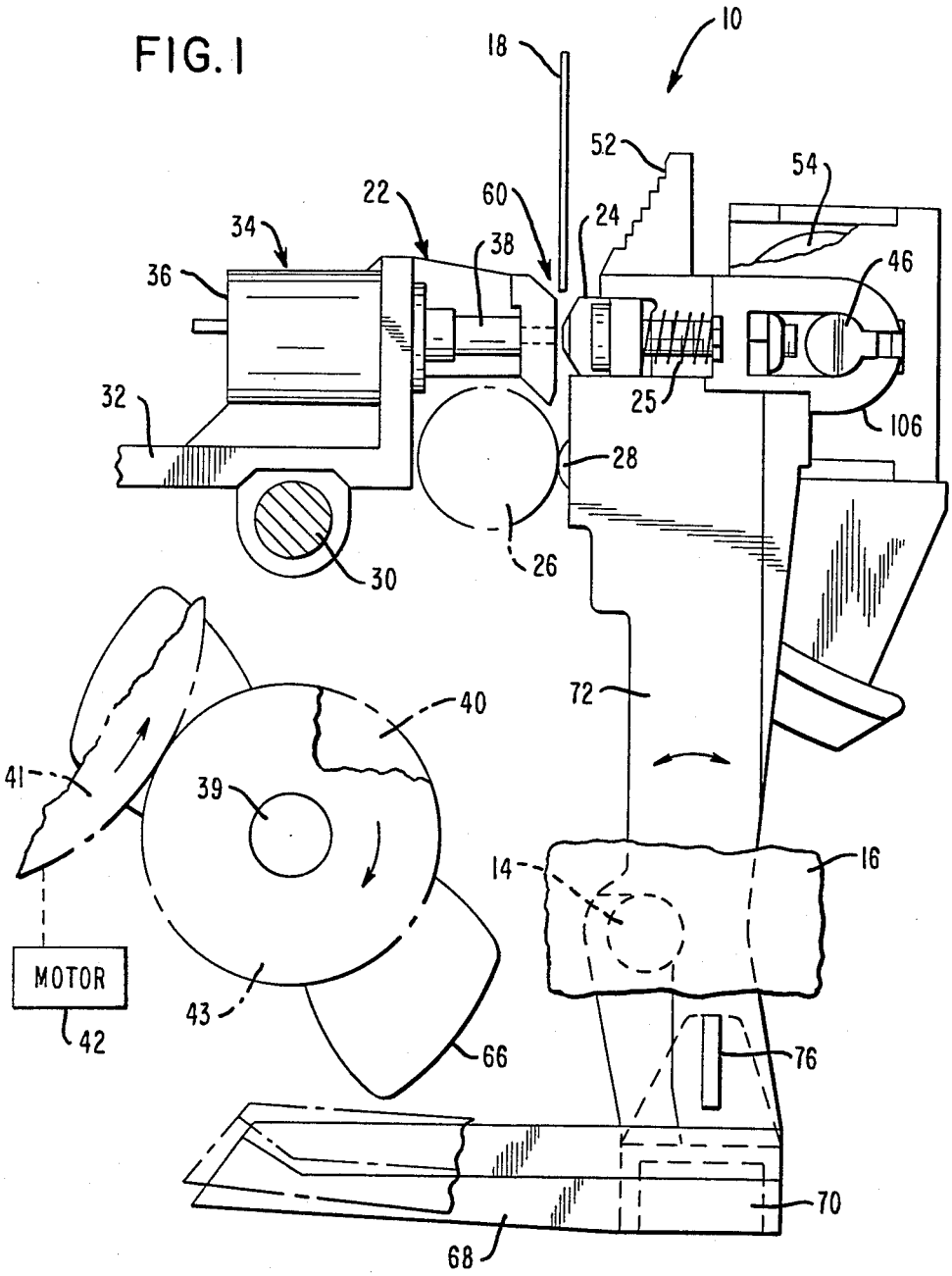
FIG. 1 is a partial side view of a printer which embodies the present invention.
Figure 2:
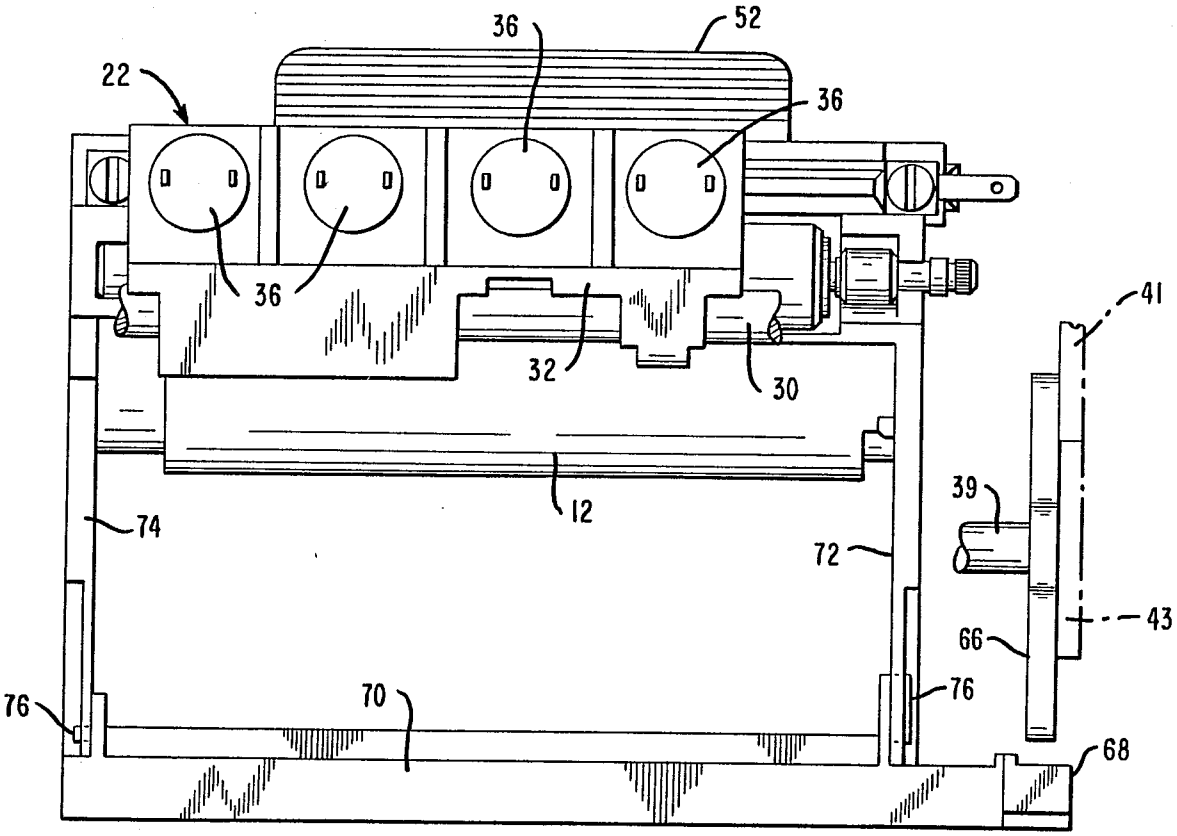
FIG. 2 is a front view of the printer of FIG. 1.

Referring now to FIGS. 1–4 inclusive, shown there is a printer 10 which includes an automatic forms compensation mechanism 12 pivotally mounted on a pair of pivots 14 journaled in the printer framework 16. Record media 18, which may comprise a single sheet or multiple sheets as in the case of forms or passbooks, are placed between a print head assembly 22 and a platen adjustably mounted by springs 25 on the forms compensation mechanism 12 for printing. Said record media extend downwardly between a paper drive roll 26 which has its bearings in the printer frame 16, and a tension roller 28, which may be fabricated from steel, and which has its bearings in the forms compensation mechanism 12.

The print head assembly 22 is carried on two shafts 30 (only one of which is shown) fixed in the machine framework 16, and comprises a carriage 32 on which are mounted a plurality of individual matrix print heads 34, each of which includes a solenoid 36 which drives a print wire carried in a guide 38. The carriage 32 is driven in reciprocating movement by a cylindrical cam 40 which is rotatably mounted on a shaft 39 in the printer frame 16, and which is driven by a motor 42 acting through a drive gear 41 meshing with a gear 43 on the shaft 39. The print wires of the print heads 34 impact against a print ribbon (not shown) to transfer ink on the ribbon to the record media 18. It will be seen that the necessary extent of reciprcating movement of the carriage 32 is approximately equal to the distance between the printing wires of adjacent print heads 34, with each print head 34 being responsible for a portion of the total area of the record media to be printed upon, depending upon the total number of print heads employed.

In high speed matrix printers, it is important to maintain a constant print gap, which is defined as the distance between the print wire in retracted position and the surface of the record media to be printed upon. The print gap should remain essentially constant regardless of the thickness of the record media 18 placed in the printer 10. This gap is maintained because the paper drive roll 26 and the print head carriage 32 are attached to the frame with respect to movement perpendicular to the plane of the record media 18, while the platen 24 and the tension roll 28 are attached to the forms compensation mechanism 12, which is pivotally mounted on said frame. Actually, the print gap increases very slightly for thick forms, because of the difference in moment arm length between the pivot 14 and the tension roll 28 on one hand, and the moment arm length between pivot 14 and the platen 24, on the other hand. This gives a desirable slight increase in impact force.

Figure 4:
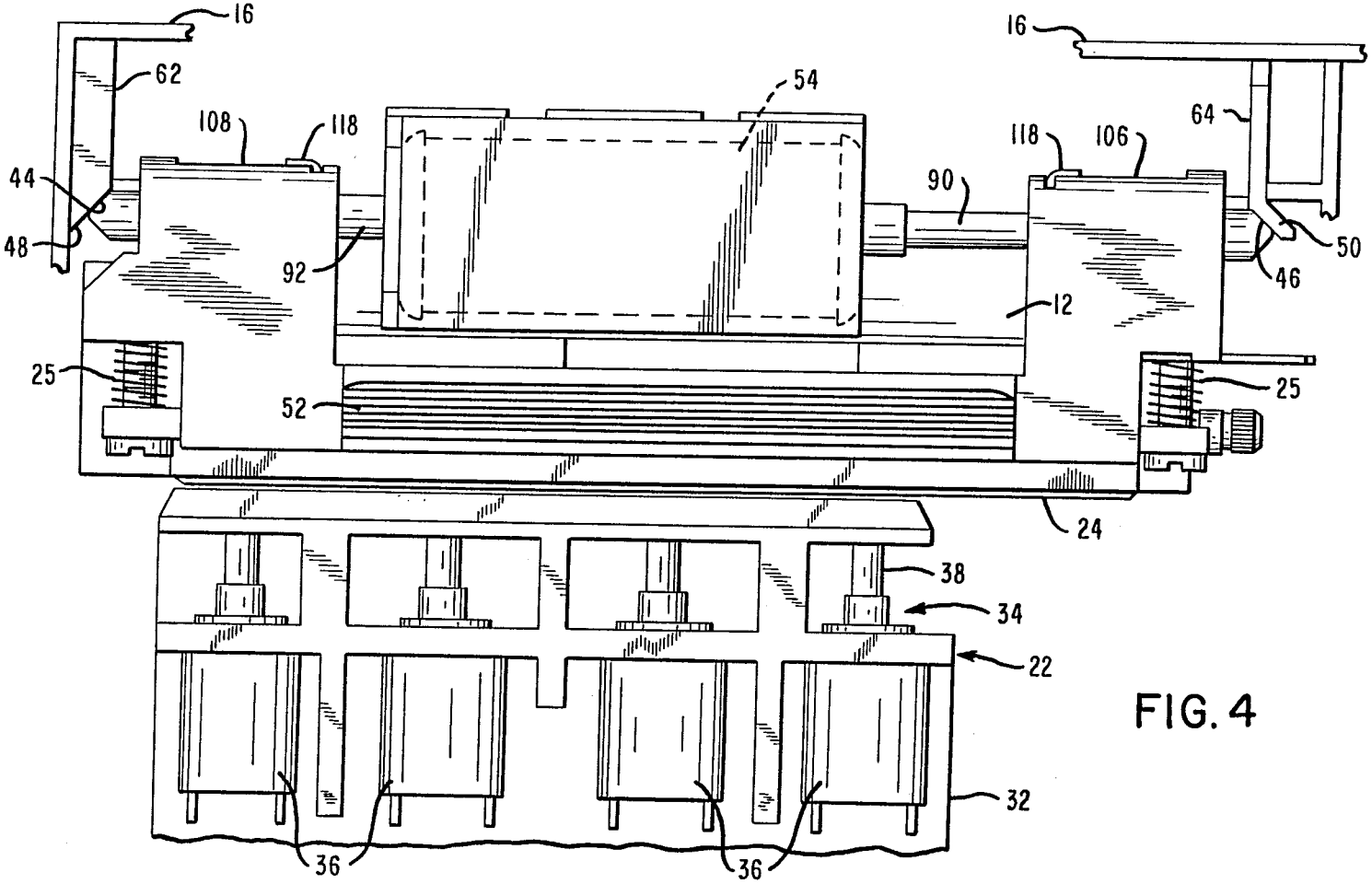
FIG. 4 is a top view of the printer of FIG. 1.

The drive pressure for feeding of record media 18 by the drive roll 26 and the force required to resist the impact of the print wires of the print heads 34 are provided by latch elements 44 and 46 which are pressed against cam surfaces 48 and 50 of the printer frame 16, as shown in FIG. 4. As will subsequently be described in greater detail, compression springs 51 force each cam surface 44 and 46 outwardly toward the frame surfaces 48 and 50. In the illustrated embodiment, the spring force is approximately 1.5 pounds on each cam surface, which provides a total of about 2.1 pounds force pushing the tension roll 28 against the feed roll 26. This force is sufficient to provide positive drive of the record media 18 and a stable platen 24 during printing.

The forms compensation arm 12 can be rocked to the right as viewed in FIG. 1 for changing or inserting record media 18 or changing an ink ribbon either by manually pressing on a serrated handle 52 on the forms compensation mechanism 12, or by applying an electrical potential to a solenoid 54 secured to the forms compensation arm 12, which causes plungers 90 and 92 to be pulled toward the center of the solenoid 54 against the force of the springs 51, thereby moving the associated latch elements 44 and 46 inwardly, out of engagement with the cam surfaces 48 and 50 on the printer frame 16. Since the center of mass of the forms compensation mechanism 12 is to the right of the pivots 14, as viewed in FIG. 1, release of the latches causes the mechanism 12 to rotate to the right in a clockwise direction under the influence of the force of gravity. This opens the throat or gap 60 between the print head assembly 22 and the platen 24, thus permitting easy insertion of record media 18 or an ink ribbon.

Figure 3:
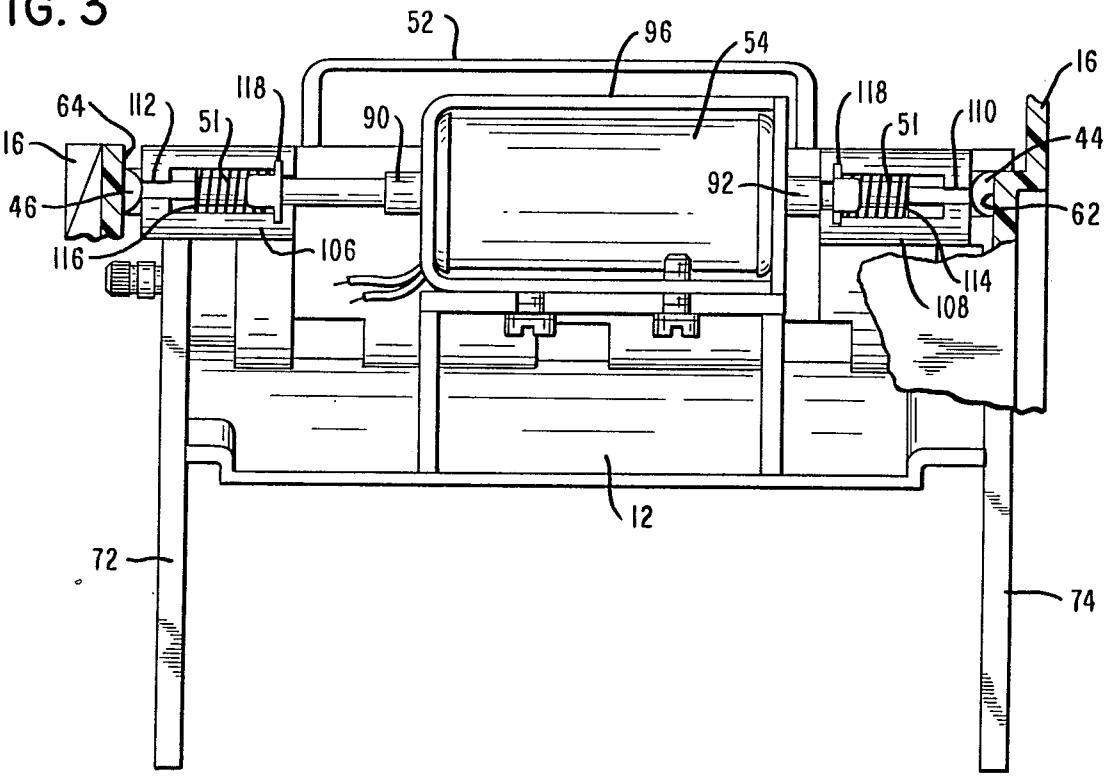
FIG. 3 is a back view of the printer of FIG. 1.

A major advantage of the present invention over conventional forms compensation mechanisms is that there is no force trying to close the mechanism after it has been opened, and the latch elements 44 and 46 are resting against inner surfaces 62 and 64 of the printer frame 16, adjacent the cam surfaces 48 and 50, as shown in FIG. 3. Conventional forms compensation designs are frequently provided with either compression or tension springs which force the forms compensation mechanism toward the paper drive roll. This force must be restrained during the time that the throat 60 is maintained in an open condition. This either makes record media changing more difficult or requires additional mechanism to lock the forms compensation mechanism in an open position. In the case of automatic throat opening, conventional designs may require a very large constant duty solenoid, often with an additional holding coil, because the solenoid must remain energized for long periods of time. In a printer employing the design of the present invention, a 24-volt pulse for a duration of 120 milliseconds has been shown to be sufficient to open the forms compensation mechanism 12.

When the record media 18 has been inserted or other necessary operation has been completed, the forms compensation mechanism can be returned to its printing position by grasping the serrated handle 52 and moving it to the left, as viewed in FIG. 1. If this is not done, the mechanism 12 will be automatically moved to the left as viewed in FIG. 1 during the first following printing operation by the action of a cam 66 engaging a lever arm 68 of a bail 70 which is attached to the arm portions 72, 74 of the mechanism 12 by projections 76, to return it to its printing position. The cam 66 is a two-element cam which is driven with the cylindrical cam 40 which drives the print head assembly 22 in reciprocating movement.

Figure 5:
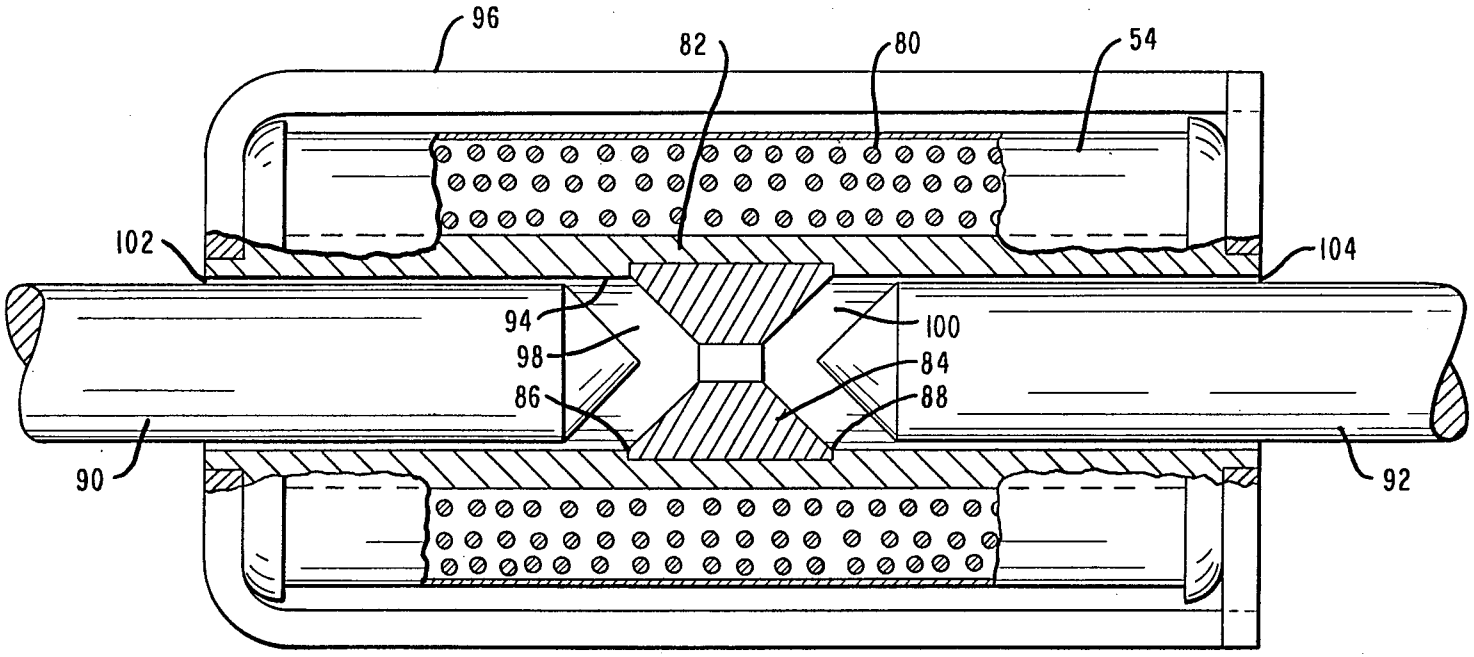
FIG. 5 is a sectional view of a solenoid and associated mechanism which may be employed in the printer of FIG. 1.

The solenoid 54 is shown in greater detail in FIG. 5, and may be described as an axial solenoid having two plungers or armatures and a single, shared coil or windings. The two plungers move in opposite directions along the same linear line of action when the coil is energized.

Coil magnet wire windings 80 are wrapped on a bobbin 82. A stationary core 84 is held firmly in place by steps 86 and 88 on the bobbin 82. The cylindrical plungers 90 and 92 move axially within the central cylindrical aperture 94 in the bobbin 82. The magnetic parts may be made from easily machinable, low carbon steel, such as AISI 1213 or 12L14. The bobbin 82 may be of injection molded thermoplastic material, such as glass reinforced nylon. If desired, the stationary core 84 may be insert molded within the bobbin 82.

When the coil is energized, the primary magnetic flux path comprises the plungers 90 and 92, the stationary core 84, the outer shell 96, working air gaps 98 and 100, and non-working air gaps 102 and 104. Magnetic flux builds up in the working air gaps 98 and 100, causing magnetic force to develop between each plunger 90, 92 and the stationary core 84, and the plungers are drawn toward the stationary core by the magnetic force.

As best shown in FIG. 3, the outer ends of the plungers 90 and 92 are supported in recesses in extensions 106 and 108 of the forms compensation mechanism 12. The latch elements 44 and 46 form parts of end members 110 and 112 which are made of plastic or other suitable material and are apertured and press fit on the ends of the plungers 90 and 92. Each end member 110 and 112 has an enlarged inner portion 114 and 116 which abuts one end of one of the solenoid return springs 51. The other end of each spring 51 abuts a clip 118 which is positioned in a slot in each extension 106 and 108.

It will be seen that the plungers 90 and 92 are normally urged outwardly by springs 51 to a position in which the latch elements 44, 46 on the end members 112 and 110 engage cam surfaces 48 and 50 of the printer frame 16 to retain the forms compensation mechanism 12 in printing position. Energization of the solenoid 54 causes the plungers 90 and 92 to be drawn inwardly against the force of the two springs 51. When these plungers are retracted, the latch elements 44, 46 no longer engage the cam surfaces 48, 50 and the forms compensation mechanism 12 moves under the force of gravity to the right as viewed in FIG. 1, so that the latch elements 44, 46 engage the surfaces 62, 64 of the frame 16, as shown in FIG. 3.

Two major advantages are realized with the single coil solenoid design of solenoid 54, as compared to the design alternative of placing two standard solenoids end-to-end. First, a smaller, more compact solenoid can be made with equivalent force-stroke characteristics and total input power, of two separate solenoids. Fewer parts are required so the potential for lower cost also exists. Secondly, if only one plunger pulls in when the coil is energized, the magnetic force developed on the stalled plunger will increase. This may cause the stalled plunger to pull in, if the reason it fails is due to a small increase in the driven load. This can happen, for example, if the coefficient of friction between a plunger and its bearing or support increases due to sticky wear debris. The force on the stalled plunger increases because, when the first working air gap closes, the total magnetic reluctance of the solenoid is reduced, which allows the flux in the working air gap of the stalled plunger to increase. This interrelationship between the magnetic force developed on the two plungers will enhance the reliability of operation of the design above that of two separate and independently operating solenoids.

While the plungers 90 and 92 are shown in FIG. 5 as having conical inner faces, flat-faced plungers could also be used if that type of force-stroke characteristic was desired. In fact, if desired, each plunger could be configured differently to achieve a different force-stroke characteristic on each plunger.

One configuration of the solenoid which has been built and tested is the box frame configuration shown in FIGS. 5 and 6. A solenoid 54 of 0.75 inch maximum coil diameter has developed in excess of 1.5 pounds force on each plunger at 0.14 inches stroke at 23.8 VDC. The coil contains 800 turns of No. 26AWG magnet wire.

The solenoid can also be constructed in other configurations such as the construction of FIG. 7 in which a U-frame 120 is employed with a coil 122 and plungers 124 and 126; or a tubular frame 128 may be employed to enclose a coil which drives plungers 130 and 132, as shown in FIG. 8.

While the forms of the invention illustrated and described herein are particularly adapted to fulfill the objects aforesaid, it is to be understood that other and further modifications within the scope of the appended claims may be made without departing from the spirit of the invention.

What is claimed is:

1. Printing apparatus comprising, in combination:

a printing frame;

a printer mounted in said printing frame;

a platen arranged in cooperative relation to said printer to enable record media to be positioned therebetween for printing thereon;

a forms compensator in which said platen is mounted, said forms compensator being pivotally mounted in said frame for movement to enable the distance between said platen and said printer to be varied to accommodate varying thicknesses of record media, including operating means to cause said forms compensator normally to move, when not restrained, into a position in which said platen is remote from said printer, in which position space between said platen and said printer is provided for insertion of record media; and latching means for latching said forms compensator in an operative position in which said platen is in an operative relationship to said printer to enable a printing operation to take platen, said latching means including retaining means on said frame and a solenoid on said forms compensator, said solenoid comprising a pair of oppositely acting armatures positioned for axial movement within said solenoid and cooperating with said retaining means on said frame, said solenoid being operable to move said armatures from latched engagement with said retaining means to permit said forms compensator to move into said remote position.

2. The printing apparatus of claim 1, in which said plungers are normally maintained in an extended separated axial position, and are urged toward each other by energization of said solenoid.

3. The apparatus of claim 2, also including spring means for maintaining said plungers in said extended position.

4. The apparatus of claim 3, in which said solenoid also includes a central stationary core member against which said plungers are moved when said solenoid is energized.

5. The printing apparatus of claim 4, in which said central stationary core member is provided with conical axial recesses on each side, and in which said plungers are provided with complementary axial projections at their inner ends.

6. The printing apparatus of claim 1, in which the forms compensator with said latching means thereon is so configured that its center of gravity is located in a portion of the forms compensator remote from the platen, so that the normal movement of the forms compensator into said remote position is caused by the force of gravity.

7. The printing apparatus of claim 1, in which said solenoid is mounted on said forms compensator in a U-frame housing.

8. The printing apparatus of claim 1, in which said solenoid is mounted on said forms compensator in a box frame housing.

9. The printing apparatus of claim 1, in which said solenoid is mounted on said forms compensator in a tubular housing.

10. Printing apparatus, comprising, in combination:

a printing frame including a pair of latch surfaces;

a printer mounted in said printing frame for reciprocating linear movement;

a platen of elongated configuration arranged in cooperative relation to said printer to enable record media to be positioned therebetween for printing thereon;

a forms compensator in which said platen is mounted, said forms compensator being pivotally mounted in said frame for movement between a first position in which the platen thereon is in operative relationship with said printer for the performance of printing operations and a second position in which said platen is remote from said printer to enable record media to be inserted between said platen and said printer; and latching means on said forms compensator for latching said forms compensator in said first position, including a single coil solenoid, a pair of oppositely acting plungers positioned for axial movement with said solenoid, and latch elements on the ends of said plungers arranged in cooperative relation to said latch surfaces on said printing frame, said plungers being spring-urged toward positions in which said latch elements on said plungers engage said latch surfaces on said printing frame to retain said forms compensator in said first position, said combined forms compensator and latching means being so configured that the force of gravity acting thereon causes said combined means to move to said second position when said latch elements of said latching means are not engaged with said latch surfaces on said printing frame, whereby energization of said solenoid enables said forms compensator to move from said first position to said second position.

11. The printing apparatus of claim 10, also including driving means for driving the printer in reciprocating movement, and means driven by said driving means for returning the forms compensator from its second position to its first position.

12. Printing apparatus comprising, in combination:

a printing frame;

a printer mounted in said printing frame;

a platen arranged in cooperative relation to said printer to enable record media to be positioned therebetween for printing thereon;

a forms compensator in which said platen is mounted, said from compensator being pivotally mounted in said frame for movement to enable the distance between said platen and said printer to be varied to accomodate varying thicknesses of record media, including operating means to cause said forms compensator normally to move, when not restrained, into a position in which said platen is remote from said printer, in which position space between said platen and said printer is provided for insertion of record media; and latching means for latching said forms compensator in an operative position in which said platen is in an operative relationship to said printer to enable a printing operation to take place, said latching means including retaining means comprising angled projections on said frame, cooperating plungers, having angled surfaces adapted to coact with said projections on said forms compensator, and at least one solenoid on said forms compensator for operating said plungers to move them from latched engagement with said retaining means to permit said forms compensator to move into said remote position.

13. Printing apparatus comprising, in combination:

a printing frame;

a printer mounted in said printing frame;

a platen arranged in cooperative relation to said printer to enable record media to be positioned therebetween for printing thereon;

a forms compensator in which said platen is mounted, said forms compensator being pivotally mounted in said frame for movement to enable the distance between said platen and said printer to be varied to accommodate varying thicknesses of record media, including operating means to cause said forms compensator normally to move, when not restrained, into a position in which said platen is remote from said printer, in which position space between said platen and said printer is provided for insertion of record media;

said platen being of elongated configuration, extending transversely of the forms compensator parallel to the axis of pivotal mounting of the forms compensator;

said printer being mounted for reciprocating movement in a path parallel to the axis of pivotal mounting of the forms compensator; and latching means for latching said forms compensator in an operative position in which said platen is in an operative relationship to said printer to enable a printing operation to take place, said latching means including fixed retaining means on said frame, cooperating latch elements on said forms compensator, and at least one solenoid on said forms compensator for operating said latch elements to move them from latched engagement with said retaining means to permit said froms compensator to move into said remote position.

14. The printing apparatus of claim 13, in which the printer comprises a plurality of individual printing devices.

15. The printing apparatus of claim 14, in which the plurality of individual printing devices are mounted on a carriage for unitary movement.

16. The printing apparatus of claim 13, also including return means for returning the forms compensator from its remote position to its operative position.

17. The printing apparatus of claim 13, also including driving means for driving the printer in said reciprocating movement.

18. The printing apparatus of claim 17, in which said return means for returning the forms compensator to its operative position is driven by said means for driving the printer in said reciprocating movement.

* * * * *

UNITED STATES PATENT AND TRADEMARK OFFICE

CERTIFICATE OF CORRECTION

PATENT NO. : 4,773,772

DATED : September 27, 1988

INVENTOR(S) : Kenneth W. Hanna et al.

It is certified that error appears in the above-identified patent and that said Letters Patent is hereby corrected as shown below:

Column 5, line 52, delete "platen" and substitute --place--.

Column 6, line 46, delete "with" and substitute --within--.

Column 7, line 6, delete "from" and substitute --forms--.

Column 7, line 9, delete "accomodate" and substitute --accommodate--.

Column 8, line 22, delete "froms" and substitute --forms--.

Signed and Sealed this

Fourteenth Day of February, 1989

*Attest:*

DONALD J. QUIGG

*Attesting Officer*

*Commissioner of Patents and Trademarks*